US005766280A

United States Patent [19]

Hallqvist et al.

[11] Patent Number: 5,766,280

[45] Date of Patent: Jun. 16, 1998

[54] METHOD FOR SHRINK FILM WRAPPING EMPLOYING TWO WEBS WHICH ARE SEALED TOGETHER

[75] Inventors: Lennart Hallqvist, Lund; Micael Åkesson, Löddeköpinge, both of Sweden

[73] Assignee: Tetra Laval Holdings & Finance S.A., Pully, Switzerland

[21] Appl. No.: 565,909

[22] Filed: Dec. 1, 1995

Related U.S. Application Data

[62] Division of Ser. No. 239,283, May 6, 1994, abandoned.

[30] Foreign Application Priority Data

May 17, 1993 [SE] Sweden ..... 9301688

[51] Int. Cl.[6] ..... B65G 11/06

[52] U.S. Cl. ..... 53/399; 53/51; 53/441; 53/590

[58] Field of Search ..... 156/85, 157, 159, 156/502, 552; 53/397, 399, 463, 466, 48.2, 48.3, 48.4, 48.6, 48.7, 228, 556, 557, 441, 442, 51, 590, 553

[56] References Cited

U.S. PATENT DOCUMENTS

| | | | |
|---|---|---|---|
| 3,564,810 | 2/1971 | Faletti et al. | 53/463 |
| 3,662,512 | 5/1972 | Zelnick | 53/557 |
| 4,024,692 | 5/1977 | Young et al. | 53/548 |
| 4,167,841 | 9/1979 | Camp | 53/399 |
| 4,319,443 | 3/1982 | Watts, Jr. | 53/553 |
| 4,662,148 | 5/1987 | Nilsson | 53/548 |

FOREIGN PATENT DOCUMENTS

| | | |
|---|---|---|
| 2-205532 | 8/1990 | Japan . |
| 2233304 | 1/1991 | United Kingdom . |

*Primary Examiner*—Richard Crispino

*Attorney, Agent, or Firm*—Burns, Doane, Swecker & Mathis, L.L.P.

[57] ABSTRACT

The disclosure relates to a method of shrink film wrapping one or more objects (12) in one or more rows. The objects are caused to be surrounded by two film webs (1, 4), which are sealed together by means of a sealing jaw (14). The objects (12) are moved in towards the two film webs (1, 4) by means of a pusher which, on its completion of the infeed movement stroke, stretches the two film webs (1, 4) in that the film webs are fixedly retained by each one of a hose brake (7, 8). When the sealing jaw (14) executes its downward stroke for completely shrouding the films (1, 4) around the objects (12), the sealing jaw (14) finally stretches the upper film (1). The film (1, 4) projecting outside the objects (12) is shrunk by means of hot air nozzles directed towards the objects (12).

11 Claims, 2 Drawing Sheets

METHOD FOR SHRINK FILM WRAPPING EMPLOYING TWO WEBS WHICH ARE SEALED TOGETHER

This application is a divisional of application Ser. No. 08/239,283, filed May 6, 1994, abandoned.

TECHNICAL FIELD

The present invention relates to a method for shrink film wrapping of one or more objects, in which two film webs—a first and a second web—are sealed together with the aid of a sealing device, and in which the objects are fed in towards the jointly sealed film webs by means of a pusher in one or more rows, whereafter the film webs are once again sealed together, severed and caused to surround the objects. The present invention also relates to an apparatus for carrying the method into effect.

BACKGROUND ART

A method common within the packaging industry for arranging distribution units is to shrink film wrap one or more objects together into a distribution unit which is appealing to the consumer. Hitherto, the shrink film wrapped objects have been wrapped by one or two film lengths into a loose banderol which, in a subsequent process, passes a hot air furnace where the film banderol is inflated by the hot air, whereafter the film shrinks about the objects. This method has entailed a relatively large material consumption of film, since the shrinkage has been difficult to calculate and a relatively large margin of film must be catered for. Furthermore, the shrinking operation has entailed that the film has formed folds and holes in the shrinking process. The wish within the art to provide such a shrink film with some form of printed artwork decor has consequently proved difficult to realize without distortion.

OBJECTS OF THE INVENTION

One object of the present invention is to realize a method for shrink film wrapping in which there is obtained an attractive and neat distribution package without the above-outlined problems.

A further object of the present invention is to reduce material consumption and make possible the employment of a thinner film.

Yet a further object of the present invention is to realize a distribution unit in which it is possible to use a pre-printed film.

SOLUTION

These and other objects have been attained according to the present invention in that the method of the type disclosed by way of introduction has been given the characterizing features that both of the films are retained and stretched by the movement of the pusher; that the first film is retained and finally stretched by the movement of the sealing device; and that parts of the film projecting outside the objects to be wrapped are subjected to thermal action.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which:

FIGS. 1 to 3 show a sequence of the method of the present invention, in a schematic version.

The Drawings show only those details essential to an understanding of the present invention, the placing of the equipment employed in its context (which is well known to a person skilled in the art) having been omitted.

DESCRIPTION OF PREFERRED EMBODIMENT

Figure 1:
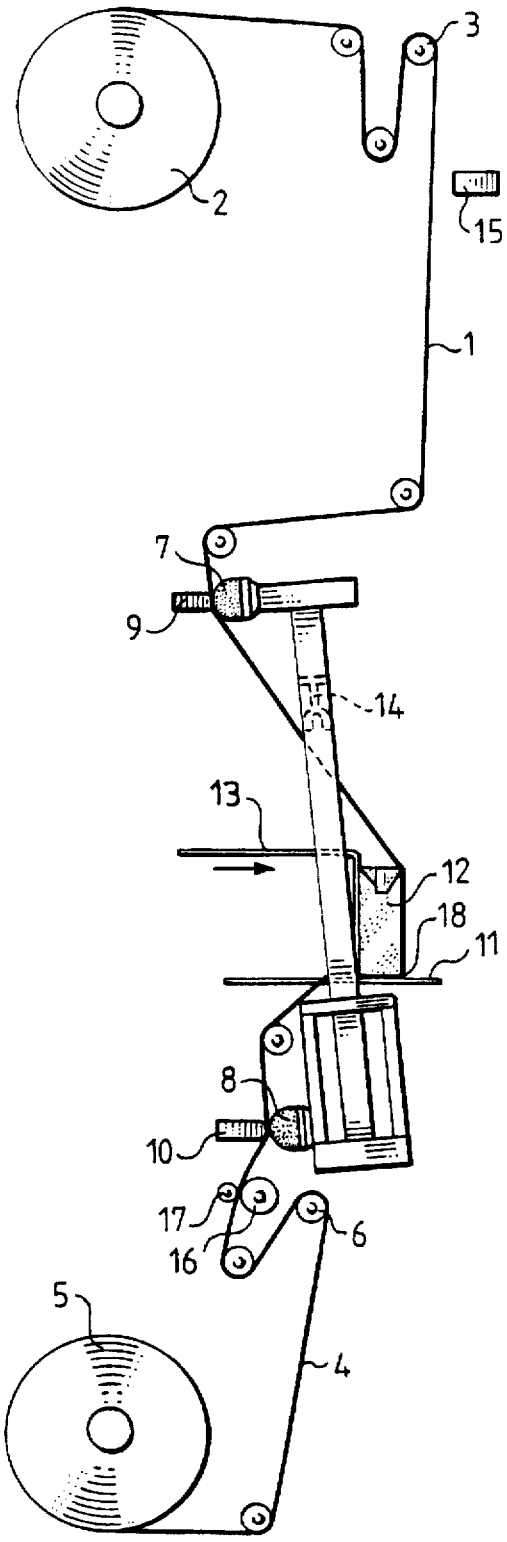

The apparatus for realizing a shrink film wrapping according to the present invention consists of a first film web 1, hereafter designated the upper film which, from a magazine reel 2, is passed via a number of bending rollers 3 through the apparatus to the point where it merges with a second film web 4, hereafter designated the lower film web. The lower film web 4 also departs from a magazine reel 5 and is brought, via a number of bending rollers 6, to merge with the first film web 1.

Both of the film webs 1 and 4 each pass a hose brake 7, 8 on their way through the apparatus. Each hose brake 7, 8 consists of an elongate hollow body which can intermittently be inflated with air and deflated. An abutment 9, 10 acts against this hollow body so that, when the hollow body is inflated with air, the film webs 1, 4 are held fast against this abutment 9, 10, and when the hollow body is deflated, the film webs 1, 4 can once again freely pass. The film web 1, 4 may also be released in that the abutment 9, 10 is moved away from the inflated hollow body.

At that point where both of the film webs 1, 4 merge together, there is provided a sliding plate 11 where the objects 12 intended for shrink film wrapping are fed in. The objects 12 are fed in by means of a pusher 13.

In connection with the sliding plate 11, there is also provided a sealing jaw 14 which is movable in the vertical plane for sealing both of the film webs 1, 4. The sealing jaw 14 slopes at an angle of approx. 5°–10° from the vertical. This inclination is arranged such that the sealing jaw 14 will be able to approach more closely to the objects 12 which are to be surrounded by the film webs 1, 4.

All of the parts included in the apparatus, i.e. hose brakes 7, 8, pusher 13 and sealing jaw 14 are mechanically interconnected with one another, eg. by means of cams so that they cooperate synchronously in a predetermined working cycle. Cams and the mechanical connection components are not shown on the Drawings.

The apparatus may moreover include a photocell 15 placed at the upper film web intended intended for decor or artwork register maintenance of artwork pre-printed on the upper film web 1. In order to make possible the employment of artwork maintenance on the upper film web 1, the lower film web 4 is simultaneously provided with a drive roller 16 which can be locked and released intermittently. The drive roller 16 drives the film 4 which is nipped against a counter roller 17. Driving of the drive roller 16 is engaged and disengaged by means of a clutch/brake.

At the starting position for shrink film wrapping of one or more objects 12, both of the film webs 1, 4 are brought together and sealed to form a first joint or seam. As is shown in FIG. 1, the pusher 13 moves a number of objects 12 marshalled in a row so that their one lower corner 18 is placed against the joint or seam of the two film webs 1, 4. In such instance, the objects 12 will stand on the lower film web 4, while the common longitudinal side of the objects moves towards the upper film web 1. Just before the pusher 13 has completed its advancement of the objects 12 and returned to its rear position, the two hose brakes 7, 8 are activated, these being disposed on each respective film web 1, 4. At this point, both of the film webs 1, 4 are locked in that the abutments 9, 10 are moved towards the inflated hollow bodies and the remaining distance of the forward stroke of the pusher 13 thereby stretches both of the film webs 1, 4 so that they tightly abut against the common longitudinal side of the objects 12. If shrink film wrapping of several rows of objects 12 is desired, the hose brakes 7 and 8 are not activated until on insertion of the last row of objects 12. This is effected in that the hollow body at the first rows is deflated and is inflated on insertion of the last row of objects 12.

Figure 2:
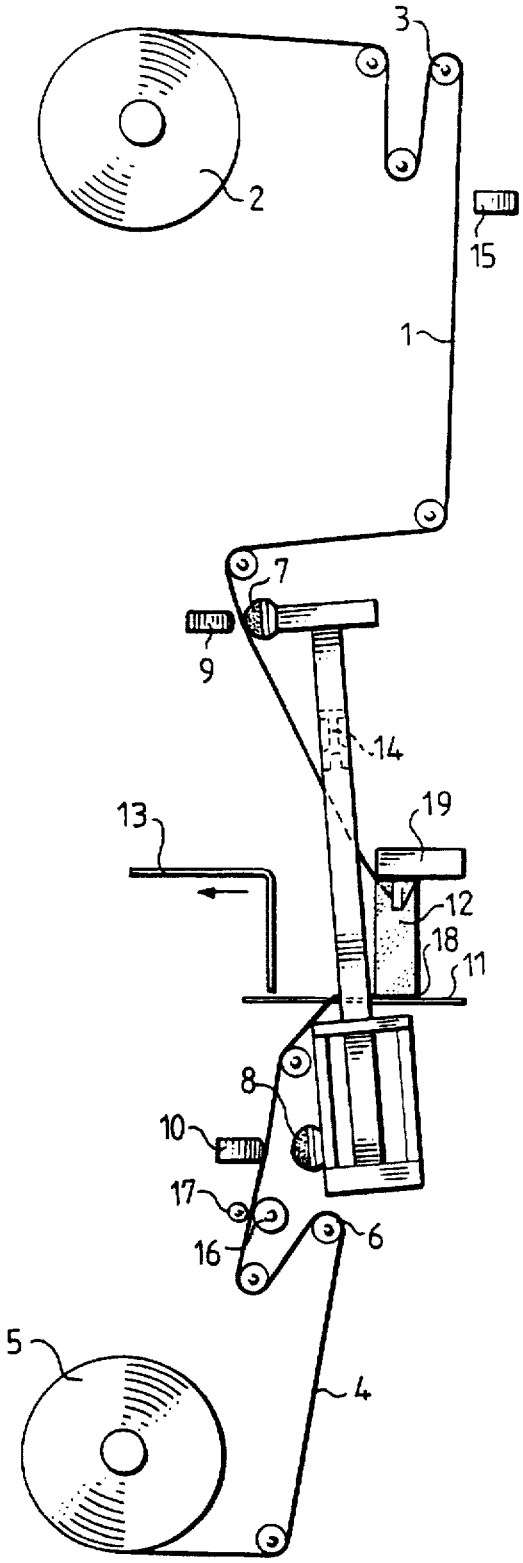

Simultaneously with the return stroke of the pusher 13, a top support 19 descends and fixedly retains the objects 12 in a position where the pusher 13 has stretched the film webs 1 and 4 so that they lie stretched against the objects 12. The top support 19 fixedly retains the objects 12 in this position and the hose brakes 7 and 8 are deactivated in that the abutments are displaced away from the inflated hollows bodies, as shown in FIG. 2, and the film webs 1, 4 may freely pass.

Figure 3:
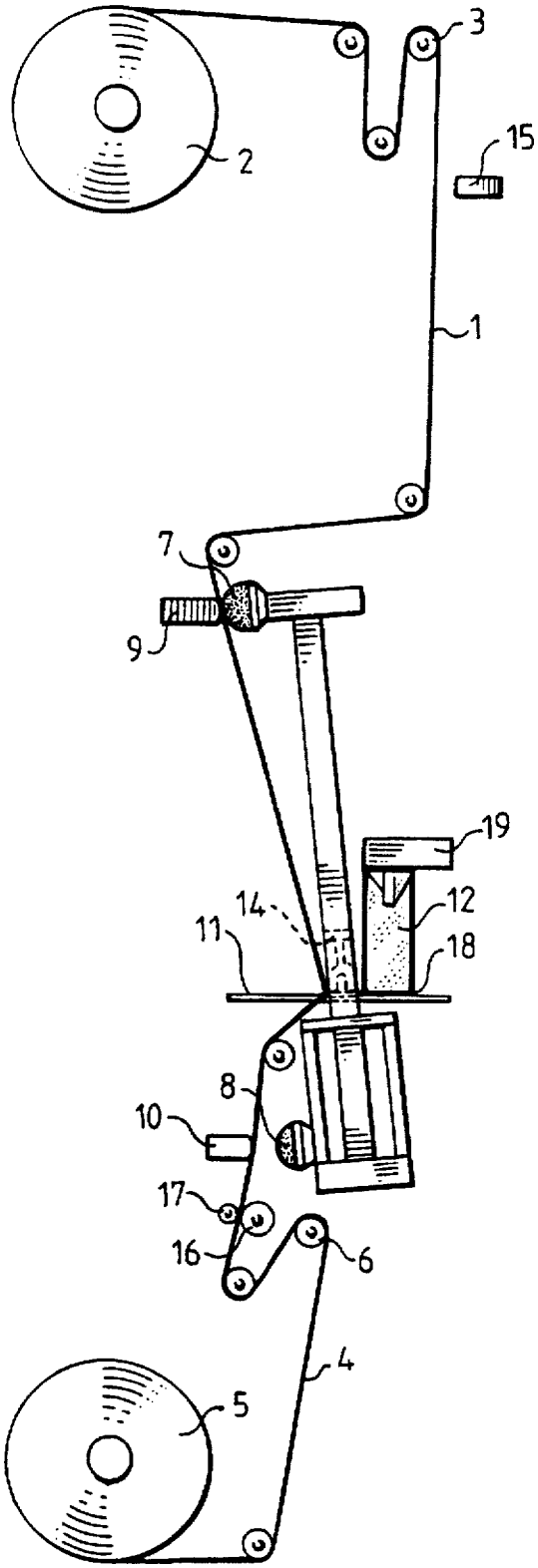

The sealing jaw 14 thereafter executes its downward stroke as illustrated in FIG. 3. Just before the sealing jaw 14 descends to the sliding plate 11, the upper hose brake 7 is once again activated in that the abutment 9 is moved via a cam towards the inflated hollow body so that the sealing jaw 14, in its remaining downward stroke, finally stretches the upper film web 1 against remaining sides of the wrapped objects 12. Both of the film webs 1, 4 are sealed together to form a sealing joint or seam consisting of two parallel seams, and the now wrapped row of objects 12 is severed from the film webs 1, 4 between the two parallel sealing joints or seams.

At this point, the apparatus is back at the starting position and the cycle is repeated. The ready-wrapped objects 12 are moved further through the apparatus where the parts of the film 1, 4 projecting outside the objects 12 are exposed to thermal action by means of hot air nozzles (not shown).

When use is made of an upper film 1 provided with pre-printed artwork, an unprinted lower film 4 is employed at the same time. The upper, pre-printed film 1 has so-called artwork markings which occur at regularly recurring spacing, which can be read-off by means of a photocell 15. The distance between the artwork markings is slightly greater than the calculated consumption for wrapping the intended objects 12.

After sealing together of the two film webs 1, 4, when the sealing jaw 14 executes its upwardly directed stroke, the photocell 15 reads-off the artwork marking. When this does not lie in register with the photocell 15, the artwork register maintenance is adjusted in that the two united film webs 1, 4 are drawn downwards into the correct position. Given that the distance between the artwork markings is slightly greater than the intended consumption of film material, this entails that the lower film web 4 is drawn, this being sealed together with the upper film web 1 so that the artwork marking can be read-off by the photocell 15. The lower film web 4 is drawn down in that the drive roller 16 is locked by means of, for example, a clutch/brake against a counter roller 17. After the compensation of the artwork register maintenance is completed, the drive roller 16 is re-released, the counter roller 17 is moved aside and the lower film 4 can freely pass the drive roller 16.

As will have been apparent from the foregoing description, the present invention realizes a shrink film wrapping which produces attractively and neatly wrapped objects, making possible the employment of film webs carrying artwork decor. With a shrink film wrapping method and apparatus according to the present invention, film consumption is reduced by between 30 and 35% and it is also possible to use a thinner film, since the above-described method largely employs the tensile strength and extensibility of the film which is supplemented with a final shrinking of residual film.

The present invention should not be considered as restricted to that described above and shown on the Drawings, many modifications being conceivable without departing from the spirit and scope of the appended Claims.

What is claimed is:

1. A method for film wrapping of one or more objects comprising the steps of:

sealing together a first and a second film web to form a continuous web;

moving said one or more objects against the continuous web by means of a pusher;

applying an increasing tension to said first and second film webs during movement of the pusher;

sealing together the first and second film webs again with the aid of a sealing device causing the objects to be surrounded, wherein the first film web is retained and finally stretched by the movement of the sealing device;

severing the first and second film webs from the wrapped one or more objects;

wherein the steps of the method are repeated cyclically; and between the cycles, a position of the first and second film webs is corrected by means of a photocell which reads an artwork marking on the first film web, whereupon the second film web, which is sealed together with the first film web, is drawn to a correct position.

2. The method for film wrapping of claim 1, further comprising a step of subjecting parts of the first and second film webs to thermal action.

3. The method for film wrapping of claim 1, wherein the second film web is drawn into position by means of a drive roller positioned against a counter roller.

4. The method for film wrapping of claim 3, further comprising the step of locking the drive roller by means of a clutch/brake.

5. The method for film wrapping of claim 1, wherein the tension is retained to stretch the film webs during the second sealing step.

6. The method for film wrapping of claim 1, wherein during the tension applying step sufficient tension is applied to said first and second film webs during movement of the pusher so as to stretch at least one of the first and second film webs.

7. The method for film wrapping of claim 6, wherein the tension stretches both the first and second film webs.

8. The method for film wrapping of claim 6, wherein the tension applying step includes locking the first and second film webs during movement of the pusher.

9. The method for film wrapping of claim 1, wherein the tension applying step includes locking the first and second film webs during movement of the pusher.

10. The method for film wrapping of claim 1, wherein the tension applied to the first and second film webs during movement of the pusher is retained by a top support during the subsequent sealing step.

11. The method for film wrapping of claim 10, wherein the top support presses the first and second film webs against the objects to retain the tension.

* * * * *